US011118448B2

(12) United States Patent
Burrafato et al.

(10) Patent No.: US 11,118,448 B2
(45) Date of Patent: Sep. 14, 2021

(54) PIPE FOR CABLELESS BIDIRECTIONAL DATA TRANSMISSION AND THE CONTINUOUS CIRCULATION OF STABILIZING FLUID IN A WELL FOR THE EXTRACTION OF FORMATION FLUIDS AND A PIPE STRING COMPRISING AT LEAST ONE OF SAID PIPES

(71) Applicant: ENI S.p.A., Rome (IT)

(72) Inventors: Sebastiano Burrafato, Rome (IT); Alberto Maliardi, San Donato Milanese (IT); Axel Turolla, Villafranca Padovana (IT)

(73) Assignee: ENI S.p.A., Rome (IT)

( * ) Notice: Subject to any disclaimer, the term of this patent is extended or adjusted under 35 U.S.C. 154(b) by 34 days.

(21) Appl. No.: 16/342,316

(22) PCT Filed: Oct. 20, 2017

(86) PCT No.: PCT/IB2017/056527
§ 371 (c)(1),
(2) Date: Apr. 16, 2019

(87) PCT Pub. No.: WO2018/073797
PCT Pub. Date: Apr. 26, 2018

(65) Prior Publication Data

US 2020/0056475 A1 Feb. 20, 2020

(30) Foreign Application Priority Data

Oct. 21, 2016 (IT) ..... 102016000106357

(51) Int. Cl.
*E21B 47/12* (2012.01)
*E21B 21/10* (2006.01)
*E21B 47/13* (2012.01)

(52) U.S. Cl.
CPC ..... *E21B 47/13* (2020.05); *E21B 21/10* (2013.01)

(58) Field of Classification Search
CPC ..... E21B 21/10; E21B 21/019; E21B 47/13
See application file for complete search history.

(56) References Cited

U.S. PATENT DOCUMENTS

2007/0246263 A1 10/2007 Reitsma
2008/0060846 A1 3/2008 Belcher et al.
(Continued)

FOREIGN PATENT DOCUMENTS

EP 1 898 044 A2 3/2008
WO WO 2009/143409 A2 11/2009
(Continued)

OTHER PUBLICATIONS

International Search Report dated Jan. 4, 2018 in PCT/IB2017/056527 filed on Oct. 20, 2017.
(Continued)

*Primary Examiner* — Taras P Bemko
*Assistant Examiner* — Yanick A Akaragwe
(74) *Attorney, Agent, or Firm* — Oblon, McClelland, Maier & Neustadt, L.L.P.

(57) ABSTRACT

A pipe for cableless bidirectional data transmission and continuous circulation of a stabilizing fluid in a well for the extraction of formation fluids includes a hollow tubular body which couples with respective drill or completion pipes; a radial valve associated with the tubular body, the radial valve connectable to a pumping system outside the tubular body; an axial valve associated with the tubular body; a communication module associated with the tubular body that includes at least one metal plate selected from a transmitting metal plate, a receiving metal plate, and a transceiver metal plate; an electronic processing and control unit that
(Continued)

processes signals to be transmitted by means of the at least one metal plate or signals received by means of the at least one metal plate; and one or more supply batteries for feeding the metal plates and the electronic processing and control unit.

8 Claims, 7 Drawing Sheets

(56) References Cited

U.S. PATENT DOCUMENTS

| | | | | |
|---|---|---|---|---|
| 2009/0289808 | A1 | 11/2009 | Prammer | |
| 2011/0114387 | A1 | 5/2011 | Belcher et al. | |
| 2012/0274477 | A1 | 11/2012 | Prammer | |
| 2013/0319767 | A1 | 12/2013 | Wilson et al. | |
| 2014/0216816 | A1* | 8/2014 | Lehr | E21B 34/06 175/40 |
| 2014/0246237 | A1 | 9/2014 | Prammer | |
| 2015/0337651 | A1 | 11/2015 | Prammer | |
| 2016/0069178 | A1* | 3/2016 | Mulholland | E21B 47/135 166/65.1 |
| 2016/0222743 | A1 | 8/2016 | Gosney | |
| 2016/0326867 | A1 | 11/2016 | Prammer | |
| 2017/0260821 | A1* | 9/2017 | Peveri | E21B 34/02 |
| 2017/0342986 | A1* | 11/2017 | Ma | E21B 47/13 |

FOREIGN PATENT DOCUMENTS

| | | | |
|---|---|---|---|
| WO | WO 2012/100259 | A2 | 7/2012 |
| WO | WO 2014/205130 | A2 | 12/2014 |
| WO | WO 2015/047418 | A1 | 4/2015 |
| WO | 2015/177607 | A1 | 11/2015 |
| WO | 2016/161411 | A1 | 10/2016 |

OTHER PUBLICATIONS

European Office Action dated Jun. 23, 2020 in European Patent Application No. 17798331.9, 5 pages.

European Office Action issued in European Patent Application No. 17 798 331.9 dated Mar. 11, 2021.

* cited by examiner

PIPE FOR CABLELESS BIDIRECTIONAL DATA TRANSMISSION AND THE CONTINUOUS CIRCULATION OF STABILIZING FLUID IN A WELL FOR THE EXTRACTION OF FORMATION FLUIDS AND A PIPE STRING COMPRISING AT LEAST ONE OF SAID PIPES

This application is a United States national stage application of International Application No. PCT/M2017/056527, filed Oct. 20, 2017, which designates the United States, and claims priority to Italian Patent Application No. 102016000106357, filed Oct. 21, 2016, wherein the entire contents of each of the above applications are hereby incorporated herein by reference in entirety.

The present invention relates to a pipe for cableless bidirectional data transmission and the continuous circulation of stabilizing fluid in a well for the extraction of formation fluids, for example hydrocarbons.

The present invention also relates to a pipe string comprising at least one of said pipes.

A well for the extraction of formation fluids can be assimilated to a duct having a substantially circular section or, in other words, a long pipeline.

As is known, rotary drilling involves the use of a drill pipe string for transmitting a rotary motion to a drill bit, and the pumping of a stabilizing fluid into the well through the same pipe string.

The pipe string typically comprises a plurality of drill pipes connected in succession with each other; in particular, the pipes are typically divided into groups of three and each group of three pipes is commonly called stand.

Ever since the conception of this type of drilling, there has been the problem of interrupting the pumping process each time a new pipe or other element in the string must be added. This time transition, identifiable from the moment in which the pumping of fluid into the well is interrupted until the pumping action into the well is resumed, has always been considered a critical period. This critical condition remains until the condition existing prior to the interruption of the pumping of fluid into the well, has been re-established.

The interruption of the circulation of fluid into the well, during the insertion and connection, or disconnection process of an element in the drill string, can cause the following drawbacks:

the dynamic pressure induced in the well by the circulation fails and its effect conventionally defined ECD (Equivalent Circulating Density) is reduced;

the dynamic pressure induced at the well bottom is zeroed, favouring the potential entry of layer fluids into the well (kick);

with the resumption of the circulation, annoying overloads of the most receptive formations can arise, or potential circulation losses in the weaker formations;

in wells having a high verticality, the unobstructed and rapid fallout of drill cuttings can cause "mechanical grip" conditions of the drill string (BHA);

in the presence of wells with a high angle of inclination, in extended reach wells and in wells with a horizontal development, the drill cuttings have time to settle on the low part of the hole; consequently when the drilling is re-started, after the insertion of a new pipe, the drill bit is "forced" to re-drill the bed of cuttings deposited at the well bottom, before being able to reach the virgin formation again.

In order to overcome the drawbacks mentioned above, the idea was conceived of interposing between consecutive pipes, more preferably between consecutive stands, a pipe having a shorter length with respect to common drill pipes and equipped with a valve system for continuous circulation.

U.S. Pat. No. 7,845,433 B2 describes an embodiment of a pipe for continuous circulation which allows the pumping to be kept uninterruptedly active and therefore the circulation of fluid in the well, during all the operating steps necessary for effecting the addition of a new pipe into the pipe string in order to drill to a greater depth.

During the various drilling phases, moreover, and in particular during the phases for changing or adding a pipe in the string, data must be received in real time from sensors positioned at the well bottom and/or along the whole pipe string.

Various systems are currently known for bidirectional data transmission from and to the well bottom, more specifically from and to the well-bottom equipment, hereinafter called "downhole tools". The current systems are mainly based on:

- a technology of the so-called "mud-pulser" type, which is based on the transmission of a pressure pulse generated with a defined sequence through the drilling fluid present in the well during all the drilling operations;
- a technology of the so-called "wired pipe" type, which consists of a particular type of wired pipes for which the electric continuity between adjacent pipes is ensured by a contact element arranged on the connection thread between the pipes themselves. According to this "wired pipe" technology, the data are therefore transmitted on wired connections;
- a so-called acoustic telemetry technology based on the transmission of acoustic waves along the drill pipes;
- a so-called "through-the-ground" technology based on electromagnetic transmission through the ground.

Each of these technologies has some drawbacks.

The "mud-pulser" technology, in fact, has limits relating to the transmission rate and reliability as it may be necessary to transmit the same signal various times before it is correctly received. The transmission capacity of this technology depends on the characteristics of the drilling fluid and the circulation flow-rate of said fluid.

The "wired pipe" technology is affected by extremely high costs as the wired pipes are very expensive; furthermore, every time a pipe must be added to the drill string, the wired connection is interrupted, thus preventing communication from and towards the well bottom during these operations.

The acoustic telemetry technology is affected by potential transmission errors due to the operating noise of the drill bit or deviation of the wells from perfect verticality.

Due to the low frequencies used for covering transmission distances in the order of kilometres, the "through-the-ground" technology is affected by an extremely low transmission rate (equivalent to that of the "mud pulser" technology) and reliability problems due to the crossing of various formation layers with different electromagnetic propagation characteristics.

The objective of the present invention is to overcome the drawbacks mentioned above and in particular to conceive a pipe for cableless bidirectional data transmission and for the continuous circulation of a stabilizing fluid in a well for the extraction of formation fluids and a pipe string, which are able to ensure, at the same time, the continuous circulation of the fluid during operations for changing or adding pipes and the continuous transmission in real time of a high amount of data from and towards the well bottom, which is independent of the operating conditions of the drill string, the drilling fluid present in a well and the circulation flow-rate of said fluid.

This and other objectives according to the present invention are achieved by providing a pipe for cableless bidirectional data transmission and for the continuous circulation of a stabilizing fluid in a well for the extraction of formation fluids and a pipe string as specified in the independent claims.

Further features of the pipe for cableless bidirectional data transmission and for the continuous circulation of a stabilizing fluid in a well for the extraction of formation fluids and the pipe string, are object of the dependent claims.

The characteristics and advantages of a pipe for cableless bidirectional data transmission and for the continuous circulation of a stabilizing fluid in a well for the extraction of formation fluids and a pipe string according to the present invention will appear more evident from the following illustrative and non-limiting description, referring to the enclosed schematic drawings, in which.

Figure 1:
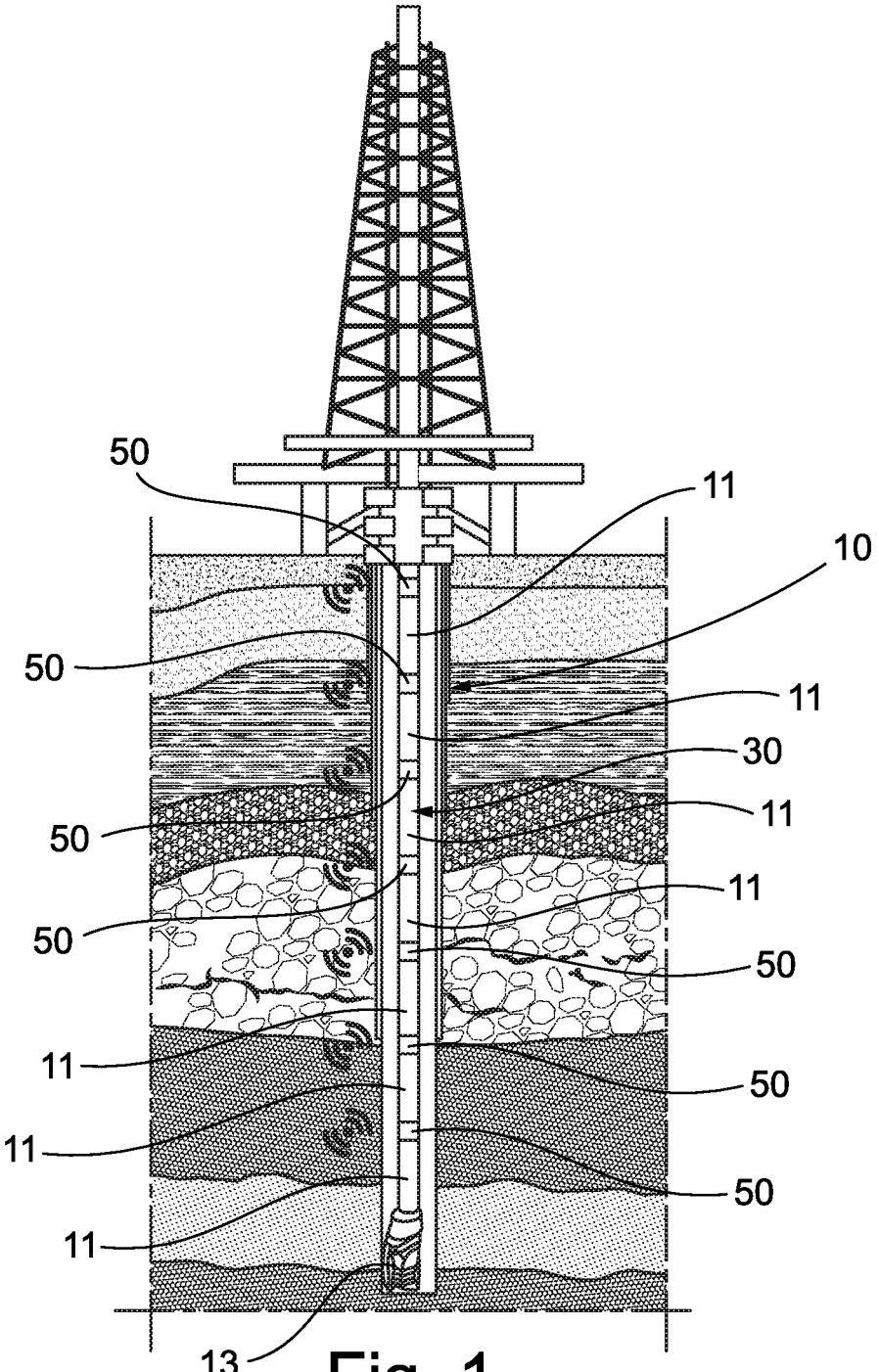
FIG. 1 is a schematic view of a drilling rig for the extraction of hydrocarbons comprising a pipe string according to the present invention.
Figure 2:
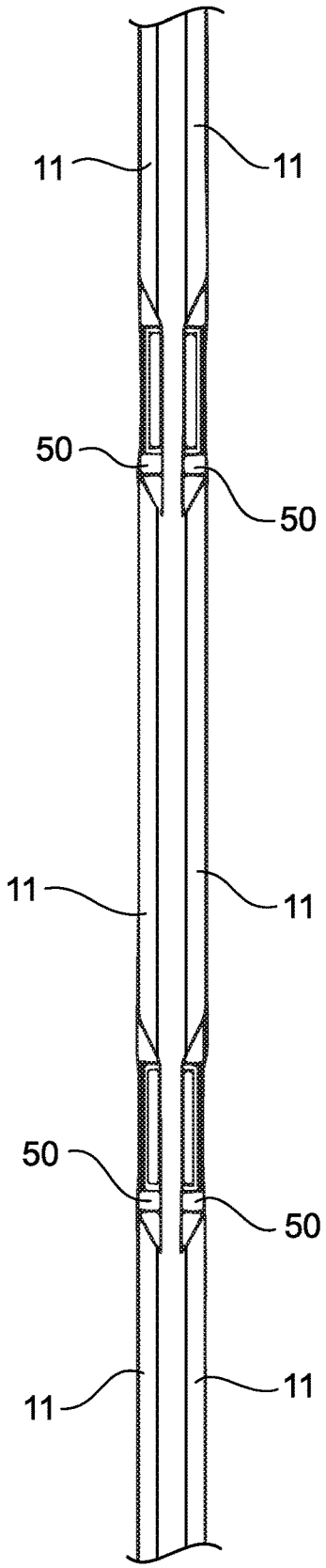
FIG. 2 is a partial sectional schematic view of an embodiment of a pipe string according to the present invention.
Figure 3A:
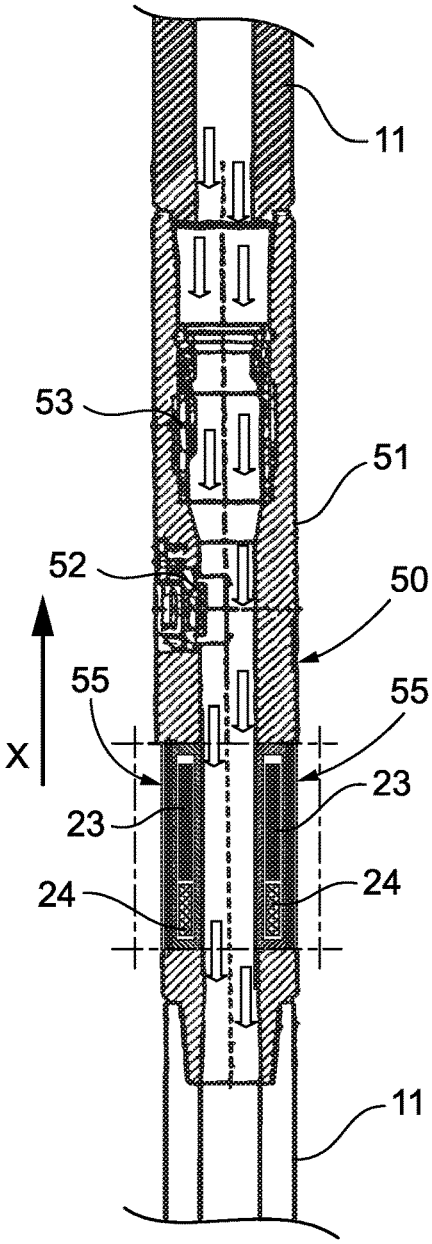
Figure 3B:
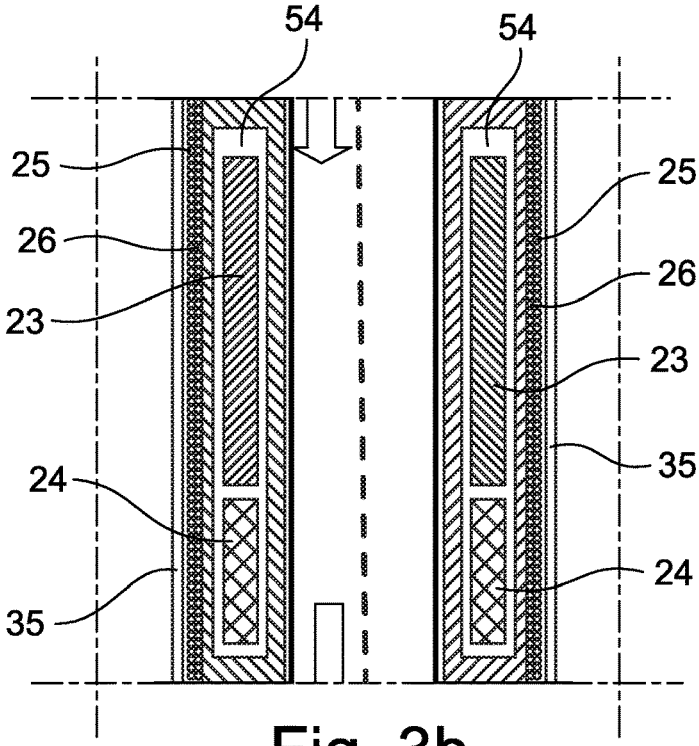
Figure 3C:
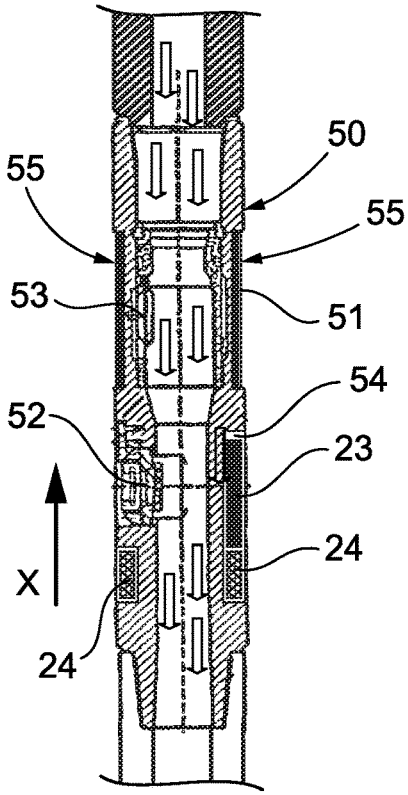
Figure 4A:
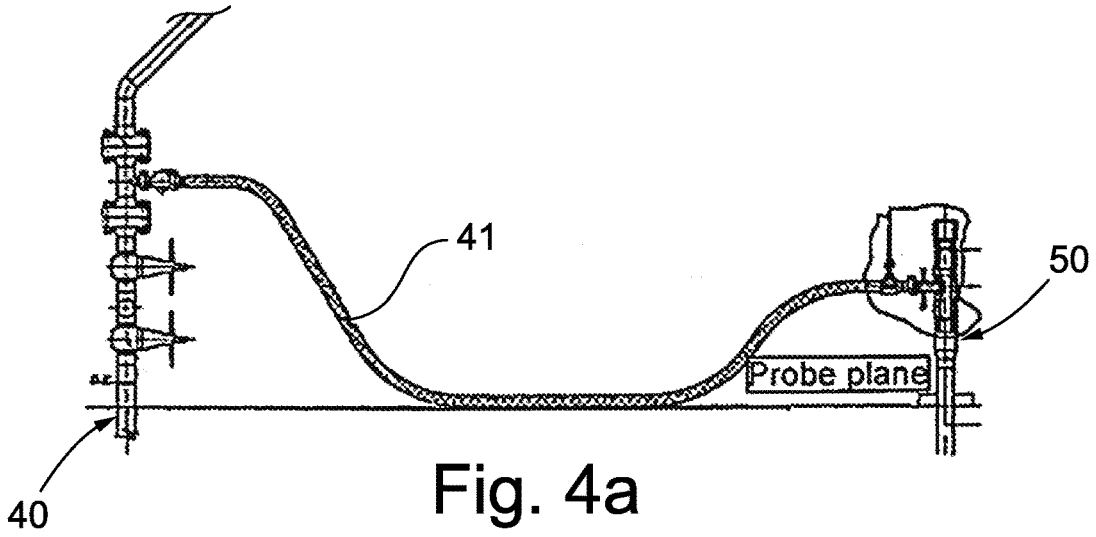
Figure 4B:
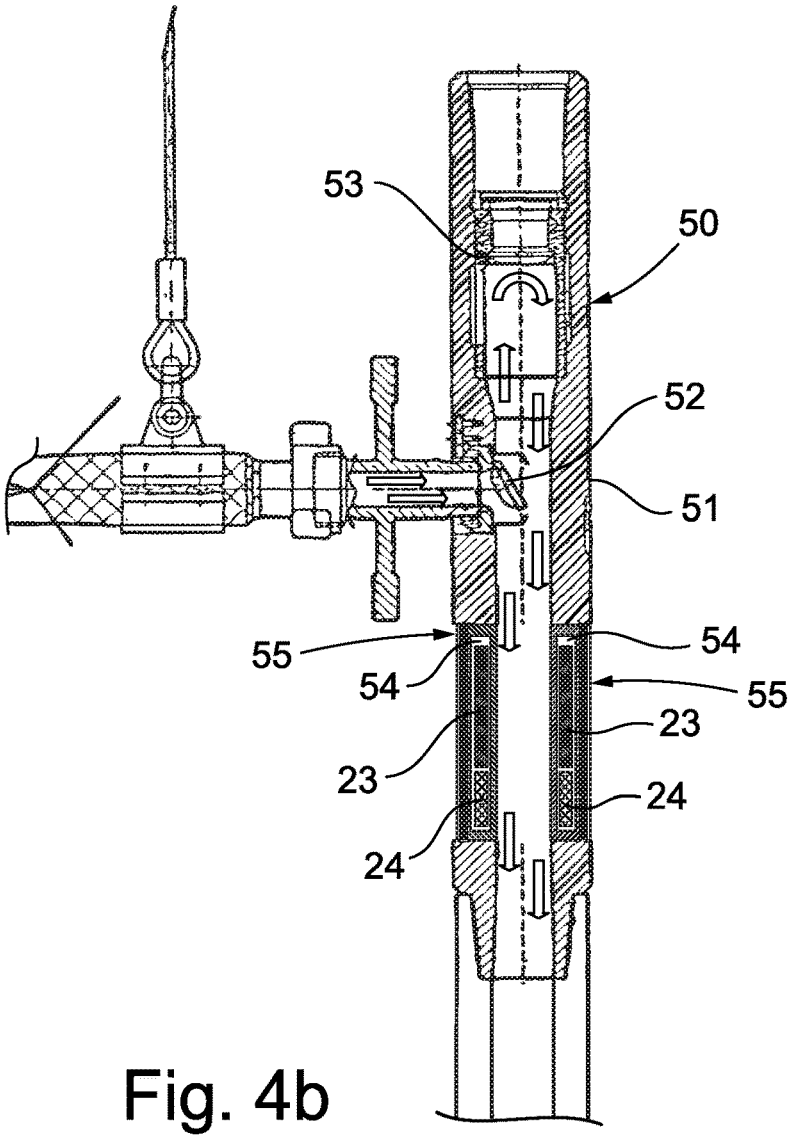

FIG. 3*a* is a schematic view of a first operational configuration of a first embodiment of a pipe for cableless bidirectional data transmission and for continuous circulation according to the present invention;

FIG. 3*b* is a view of a detail of FIG. 3*a* framed by dashed lines;

FIG. 3*c* is a schematic view of a first operational configuration of a second embodiment of a pipe for cableless bidirectional data transmission and for continuous circulation according to the present invention;

FIG. 4*a* shows a connection between a pipe for cableless bidirectional data transmission and for continuous circulation according to the present invention and a pumping system included in the drilling rig of FIG. 1;

FIG. 4*b* is a view of a detail of FIG. 4*a;*

Figure 5:
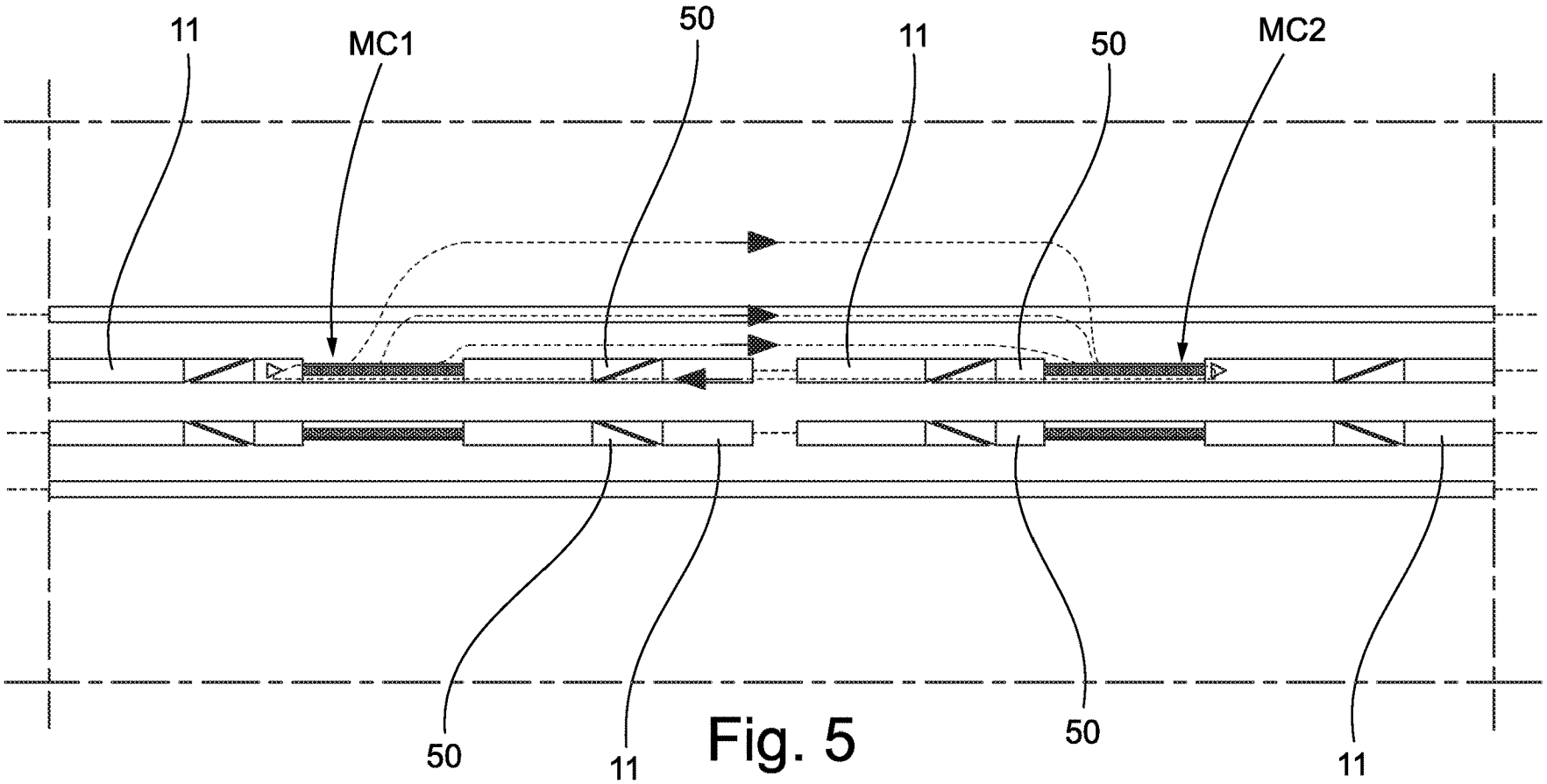
Figure 6A:
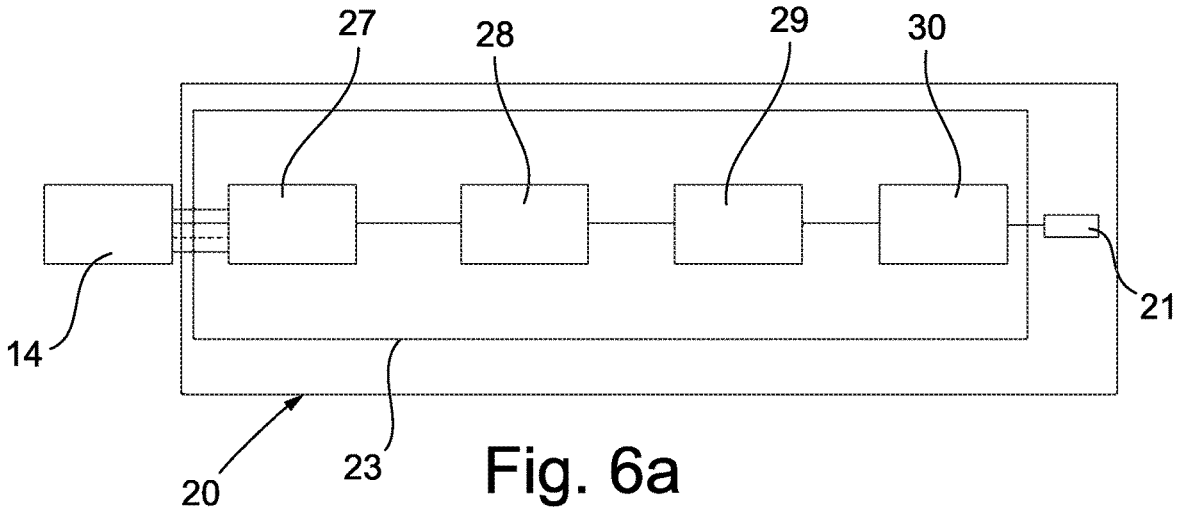
Figure 6B:
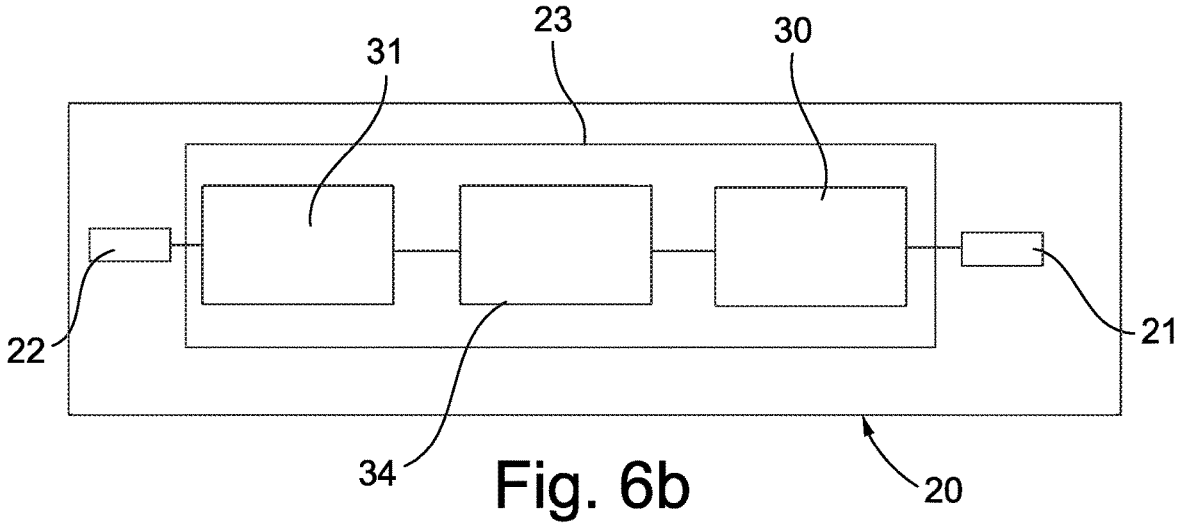
Figure 6C:
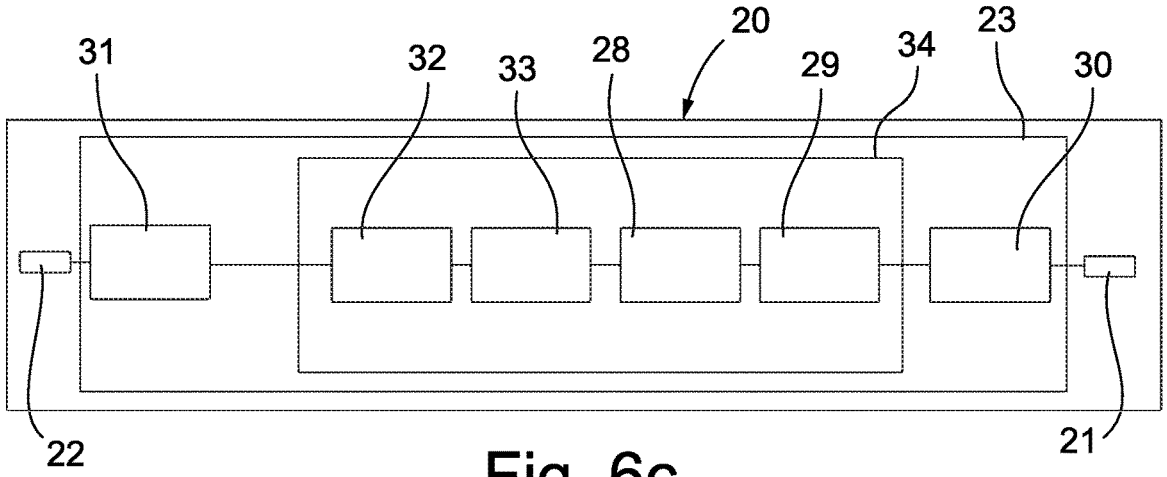
Figure 7:
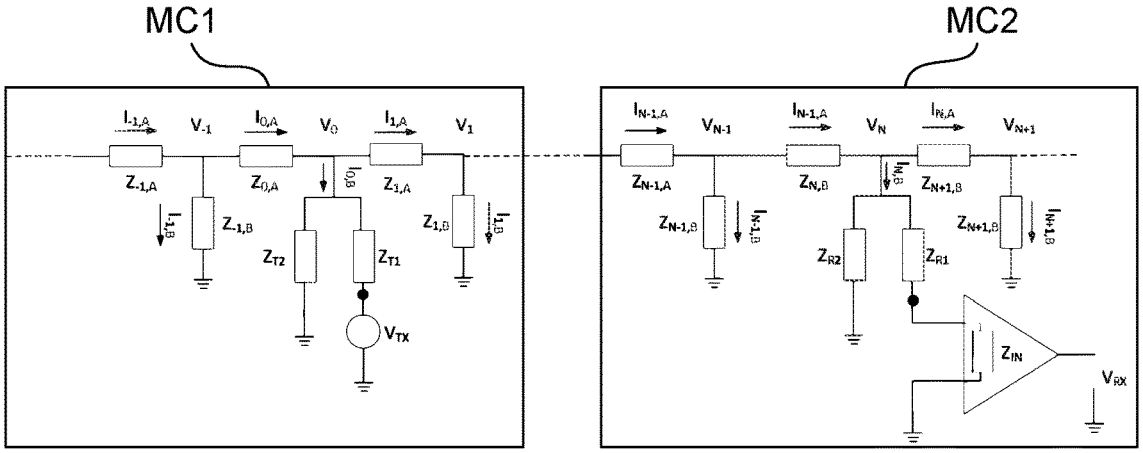
Figure 8:
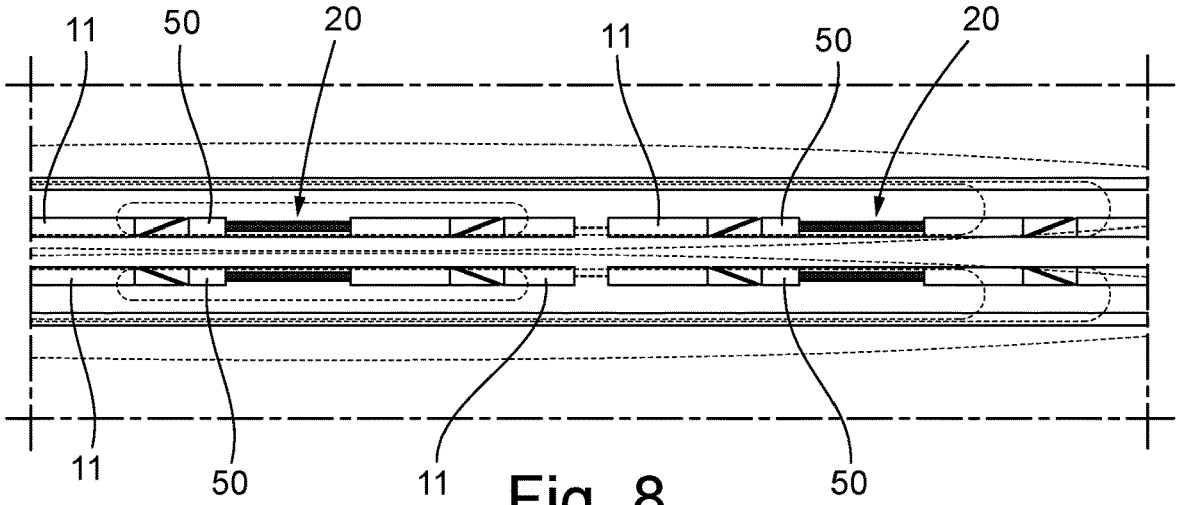
Figure 9:
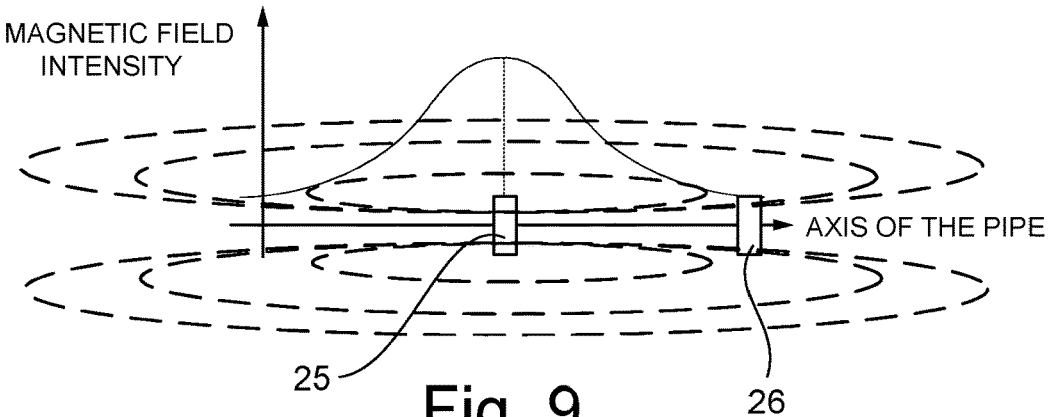

FIG. 5 is a schematic view which represents two communication modules provided with transmitting and receiving metal plates and housed in two pipes for cableless bidirectional data transmission and continuous circulation of the same pipe string; figure also illustrates examples of current flow lines between the two modules;

FIG. 6*a* is a block diagram which represents a communication module connected to a plurality of sensors;

FIG. 6*b* is a block diagram which represents a communication module acting as a repeater;

FIG. 6*c* is a block diagram which represents a communication module acting as a regenerator;

FIG. 7 is a circuit diagram which represents a model for the configuration of FIG. 5;

FIG. 8 is a schematic view which represents two communication modules provided with transmitting and receiving coils and housed in two pipes for cableless bidirectional data transmission and continuous circulation of the same pipe string; FIG. 8 also illustrates examples of magnetic field flow lines between the two communication modules;

FIG. 9 is a graph which represents the distribution of the magnetic field intensity between two communication modules such as those of FIG. 8.

With reference in particular to FIG. 1, this schematically shows a generic well for the extraction of formation fluids, such as, for example, hydrocarbons. The well is indicated as a whole with the reference number 10.

The well 10 is obtained by means of a drilling rig which comprises a pipe string 60 according to the present invention.

The pipe string 60 can be a drill string or also a completion pipe string used during the production steps of the well 10.

The pipe string in any case comprises a plurality of pipes 11, 50 connected to each other in succession, which extends from the surface as far as the well bottom 10. A bit 13 or other excavation or drilling tool can be connected to the lower end of the pipe string.

The pipes 11, 50 can be hollow and have a substantially circular section; said pipes, when connected to each other in succession, therefore create an internal duct as shown for example in FIGS. 3*a* and 3*b*. The drilling rig comprises a pumping system 40, also called rig pump manifold, associated with the pipe string 60 suitable for pumping stabilizing fluid inside the internal duct, generating a primary flow directed towards the bottom of the well. The stabilizing fluid therefore crosses the pipe string 60 until it exits close to the bit 13.

The pipe string 60 can be associated with a plurality of sensors 14, so-called MWD ("Measurement While Drilling"), that can be positioned along the string and in particular in correspondence with the well bottom 10. Said MWD sensors 14 are configured for continuously detecting a plurality of parameters relating to the fluids circulating in the well and the rock formation surrounding the well 10. These MWD sensors 14 can, for example, be density or resistivity sensors configured for continuously measuring, respectively, the density value and the resistivity value of the drilling fluid and so forth. The pipe string 60 can also be associated with safety devices or other remote-controlled well instrumentation (not shown).

The plurality of pipes 11, 50 comprises a plurality of drill or completion pipes 11 and a plurality of pipes for cableless bidirectional data transmission and continuous circulation 50 according to the present invention. Said pipes for cableless bidirectional data transmission and continuous circulation 50 have a length, for example ranging from 50 to 200 cm, shorter than that of the drill or completion pipes 11.

The pipes for cableless bidirectional data transmission and continuous circulation 50 are positioned along the pipe string 60 between two drill or completion pipes 11 at pre-established intervals of one or more drill or completion pipes 11.

The pipes for cableless bidirectional data transmission and continuous circulation 50 are preferably positioned along the pipe string at intervals of three drill or completion pipes.

In this case, the groups of three drill or completion pipes interconnected with each other are commonly called stands.

The pipe for cableless bidirectional data transmission and continuous circulation 50 advantageously has a hollow tubular body 51 which extends in length along a longitudinal direction X and which is configured at the ends for being coupled with respective drill or completion pipes 11. This coupling can, for example, be of the threaded type or prismatic type.

The tubular body 51 is provided with a radial valve 52 configured for regulating the flow of a fluid in a substantially radial or transversal direction with respect to the longitudinal direction X and an axial valve 53 configured for regulating the flow of a fluid along said longitudinal direction X. In particular, the axial valve 53 is configured for regulating the flow of primary fluid pumped from the pumping system. The radial valve 52 can be advantageously connected to the pumping system 40 outside the tubular body 51. Said radial valve 52 is preferably connected to said pumping system 40 by means of a connector or adaptor coupled with a flexible pipe 41 fed by the pumping system itself.

The radial valve 52 is preferably provided with a safety cap, preferably pressure-tight.

The radial valve 52 and the axial valve 53 are more preferably butterfly valves.

The radial valve 52 and the axial valve 53 are more preferably butterfly valves preloaded with springs.

During the drilling, the radial valve 52 is advantageously kept closed with the safety cap whereas the axial valve 53 is kept open so as to allow the passage of the stabilizing fluid towards the well bottom.

When a further pipe 11 must be added to the pipe string, the intervention is effected on the pipe for cableless bidirectional data transmission and continuous circulation 50 closest to the surface, as follows. The pumping system is connected to the radial valve 52 by means of the flexible pipe 41, for example, and the flow of primary fluid through the injection head at the inlet of the pipe string 60, is interrupted. The axial valve 53 is closed, the radial valve 52 is opened and the flow of secondary fluid through the flexible pipe 41, is activated. At this point, a new pipe 11 can be inserted in the pipe string above the connecting pipe 50 connected to the pumping system. Once the pipe string 60 has been assembled with the new pipe, the radial valve 52 is closed, the axial valve 53 is opened and the flow of primary fluid is restored through the supply of the injection head of the pipe string 60.

The pipe for cableless bidirectional data transmission and continuous circulation 50, according to the present invention, also comprises a communication module 20 associated with the tubular body 51.

As can be seen in FIG. 3*a*, the tubular body 51 preferably has a first longitudinal portion for continuous circulation with which the radial valve 52 and the axial valve 53 are associated, and a second longitudinal portion for cableless bidirectional data transmission with which the communication module 20 is associated.

In this case, the first and the second longitudinal portions are consecutive with respect to each other.

According to an alternative embodiment illustrated in FIG. 3*c*, the first longitudinal portion for continuous circulation and the second longitudinal portion for cableless bidirectional data transmission are partially superimposed. In this case, some housings for the communication module can be produced in correspondence with the first longitudinal portion for continuous circulation so as to obtain a more compact configuration with respect to the pipe for cableless bidirectional data transmission and continuous circulation 50 of FIG. 3*a*.

According to the present invention, each communication module 20 comprises:

at least one metal plate 21, 22, 35 selected from:

a transmitting metal plate 21;

a receiving metal plate 22 a transceiver metal plate 35;

an electronic processing and control unit 23, for example comprising a microprocessor, configured for processing signals to be transmitted by means of the at least one metal plate 21, 35 or signals received by means of the at least one metal plate 22, 35;

one or more supply batteries 24 for feeding the metal plates 21, 22, 35 and the electronic processing and control unit 23.

In each communication module 20, the metal plates 21, 22, 35 are advantageously electrically insulated from the metallic body of the connecting pipes 50.

In this way an electric contact between the metal plates 21, 22, 35 and the metallic body of the connecting pipes 50 is avoided.

The metal plates 21, 22, 35 are preferably arc-shaped.

In a particular embodiment of the present invention, each communication module 20 comprises two transmitting metal plates 21 and/or two receiving metal plates 22.

If the communication module 20 comprises a transceiver metal plate 35, the receiving and transmitting operations, even if simultaneous, are effected in suitably separate frequency bands. This allows, for the same overall dimensions, the size of the plate to be increased, improving the transmission and reception efficiency.

In addition to the at least one metal plate 21, 22, 35, as illustrated in FIGS. 3*a*, 3*b*, 3*c* and 4*b*, each communication module 20 can comprise at least one transmitting coil 25 and at least one receiving coil 26, coaxial to each other and coaxial with respect to the longitudinal axis of the pipe for cableless bidirectional data transmission and continuous circulation 50 with which they are associated.

More specifically, the at least one transmitting coil 25 has a few turns, for example in the order of tens, and a conductor with a large diameter, for example larger than 1 mm, in order to maximize the current flowing through the conductor itself and therefore the magnetic field proportional to it, and minimize the power dissipation.

The at least one receiving coil 26, on the other hand, has a high number of turns, for example in the order of a few thousands, in order to contain the signal amplification gain within reachable practical limits and improve the amplification performances.

The at least one transmitting coil 25 and the at least one receiving coil 26 are preferably superimposed on each other, as illustrated in FIGS. 3*a*, 3*b*, 3*c* and 4*b*, in order to limit the encumbrance along the longitudinal axis of the pipe for cableless bidirectional data transmission and continuous circulation 50 with which they are associated.

The supply batteries and electronic processing and control unit 23 can preferably be housed in one or more housings; in the embodiment illustrated in detail in FIG. 3*b*, the supply batteries and electronic processing and control unit 23 are housed in a first housing 54, whereas the metal plate 21, 22, 35 and coils 25, 26 are housed in a second housing 55. The housings 54 assigned for housing the batteries and electronic processing and control unit 23 are closed towards the outside of the pipe for cableless bidirectional data transmission and continuous circulation 50; they are in fact produced by compartments inside the pipe.

The housings 55 of the coils 25, 26 and metal plates 21, 22, 35, on the other hand, are open towards the outside of the pipe, as they are formed by recesses in the side surface of the pipe for cableless bidirectional data transmission and continuous circulation 50, as can be seen in FIG. 3*b*.

In particular, the coils 25, 26 are wound around the pipe for cableless bidirectional data transmission and continuous circulation 50 in correspondence with the recesses 55 and afterwards, the at least one metal plate 21, 22, 35 is arranged in a position facing the outside so that, during normal use, it is in direct contact with the fluids circulating in the well.

In the particular embodiment illustrated in FIG. 3*a*, the first housing 54 and the second housing 55 are produced in a longitudinal direction beneath the first longitudinal portion for continuous circulation, in particular beneath the radial valve 52.

In the embodiment illustrated in FIG. 3*c*, on the contrary, the first housing 54 is formed in correspondence with the radial valve 52 whereas the second housing 55 is formed in correspondence with the axial valve 53.

The communication between two consecutive communication modules 20 of the pipe string 60 can therefore take place using the electric current injected into the mud from the transmitting metal plate or transceiver metal plate 35 of one module and captured by the receiving metal plate 22 or transceiver metal plate 35 of the subsequent module, and/or a magnetic field generated by the coil 25 of one module and concatenated by the coil 26 of the subsequent module.

In any case, the communication modules 20 can be configured for acting as transmitters and/or receivers and/or repeaters and/or regenerators.

In particular, if the single communication module is configured for acting as a signal transmitter, for example as in FIG. 6*a*, the electronic processing and control unit 23 is configured for acquiring and processing the detection data from the sensors 14 or the control signals for the safety devices and other well-bottom instruments. In this case, the electronic processing and control unit 23 comprises a data acquisition module 27 which is configured for creating data packets to be transmitted, a coding module 28 for encoding said data packets, modulation circuits 29 for modulating the signals corresponding to the encoded data packets and output amplification circuits 30 for amplifying the modulated signals and feeding the transmitting metal plate 21 or transceiver metal plate 35 and/or the transmitting coil 25.

Correspondingly, in a communication module 20 configured for acting as signal receiver, the electronic processing and control unit 23 comprises an input amplification circuit 31 for amplifying the signal received from the receiving metal plate 22 or transceiver metal plate 35 and/or from the receiving coil 26, demodulation circuits 32 of said signal received and amplified and a decoding module 33 of the demodulated signal.

In a communication module 20 configured for acting as signal repeater as, for example, in FIG. 6*b*, the electronic processing and control unit 23 comprises input amplification circuits 31 for amplifying the signal received from the receiving metal plate 22 or transceiver metal plate 35 or from the receiving coil 26, circuits for re-modulating 34 the signal to be re-transmitted at a different carrier frequency with respect to that of the signal received and output amplification circuits 30 for amplifying the re-modulated signal. This modification of the carrier, effected by an analogue circuit, is required for preventing the communication module 20 from being affected by the crosstalk phenomenon creating inevitable problems in the transfer of information.

In a communication module 20 configured for acting as signal regenerator as, for example, in FIG. 6*c*, the electronic processing and control unit 23 comprises input amplification circuits 31 for amplifying the signal received from the receiving metal plate 22 or transceiver metal plate 35 or from the receiving coil 26, demodulation circuits of said signal received and amplified, a decoding module 33 of the demodulated signal, a coding module 28 of the signal previously decoded, modulation circuits 29 for re-modulating the signal to be retransmitted at a different carrier frequency with respect to that of the signal received (to prevent the communication module 20 from being affected by the crosstalk phenomenon creating inevitable problems in the transfer of information) and output amplification circuits 30 for amplifying the re-modulated signal.

More specifically, the data to be transmitted are organized in packets having a variable length, for example from 10 bits to 100 kbits. Each data packet can undergo, for example, a source encoding process for the data compression and/or a channel encoding process for reducing the possibility of error. The modulation circuits 29 transform the single data packet into an appropriate signal with characteristics suitable for transmission inside the well 10.

An example of modulation used is DQPSK (Differential Quadrature Phase Shift Keying), according to which a sinusoidal signal is generated with a certain carrier frequency f, ranging, for example, from 1 to 30 kKz, whose phase varies according to the value of each sequence having a length of 2 bits; the phase can therefore acquire four values, for example ($\pi/4$, $3/4\pi$, $-\pi/4$, $-3/4\pi$). Each pair of bits can be mapped in the absolute phase of the sinusoid or in the relative phase difference (Differential QPSK) with respect to the sinusoid corresponding to the previous pair of bits. This latter choice is preferable as it makes the inverse demodulation process simpler in the next communication module, as it will not be necessary to estimate the exact value of the frequency f due to the fact that the error introduced by the lack of estimation can be eliminated by means of techniques known in the field. Furthermore, the waveform can be filtered with a suitable root raised cosine filter to limit the band occupation of the signal, with the same transmission rates.

The modulated voltage signal thus obtained is amplified to voltages with values ranging, for example, from 1 to 100 V by the output amplification circuits 30 capable of supplying the current, with peak values ranging, for example, from 0.1 to 10 A.

The input amplification circuits 31 of the subsequent communication module 20 transform the current flowing through the receiving metal plate 22 or transceiver 35 into a voltage signal with peak values of a few volts; these input amplification circuits 31, moreover, adapt the impedance of the receiving metal plate 22 or transceiver 35, preventing the voltage entering the subsequent device from being attenuated due to a "divider" effect.

In order to explain the transmission method implemented by means of the metal plates 21, 22, 35, the exemplary case can be considered of the transmission from a first communication module 20 MC1, comprising a transmitting metal plate 21, to a second communication module 20 MC2, comprising a receiving metal plate 22, as in the case illustrated in FIG. 5. The considerations referring to this configuration can apply to the case of the transmission between two transceiver metal plates 35 or between a transmitting metal plate 21 and a transceiver metal plate 35. The configuration of FIG. 5 is schematized by the electric diagram illustrated in FIG. 7 with the following considerations:

the ground reference is given by the metal body, typically made of steel, the connecting pipes 50 which, in the diagram, are considered as being ideal conductors;

Vi indicates an electric potential which varies along the longitudinal axis of the well 10;

Ii indicates an electric current which varies along the longitudinal axis of the well 10;

V0 indicates the electric potential produced by a transmitting metal plate 21;

Zi,A indicates an infinitesimal "longitudinal" electric impedance, which opposes the current flowing in a longitudinal direction, i.e. parallel to the longitudinal axis of the well 10;

Zi,B indicates an infinitesimal "radial" electric impedance, which opposes the stream flowing in a radial direction, i.e. orthogonal to the longitudinal axis of the well 10.

More specifically, it can be considered that Zi,A=zi,AdL and Zi,B=zi,B/dL, wherein:

dL is the physical length of the infinitesimal section to which Zi,A and Zi,B refer respectively; and Zi,A and Zi,B are the "specific impedances" per unit of length of the pipe-plate assembly which depend on the geometry and corresponding specific electric parameters (conductivity, dielectric constant) of said assembly.

The transmitting metal plate 21 of the first module MC1 injects into the fluid surrounding the pipe string, a variable electric current modulated by the information signals carrying the data to be transmitted.

The current flows through the fluid, through the casing, if present, and through the rock formation surrounding the well 10, subsequently returning to the ground reference of the transmitting metal plate 21 through the steel of the pipe for cableless bidirectional data transmission and continuous circulation 50 with which the plate is associated.

A part of this current reaches the receiving metal plate 22 of the second communication module MC2. This current is amplified and then acquired by the electronic processing and control unit to extract the information contained therein, or directly re-amplified to be re-transmitted to a third communication module.

In the electric diagram of FIG. 7, the electronic processing and control unit of the first communication module MC1, is represented by a voltage generator having an amplitude VTX, whereas the transmitting metal plate 21 is represented by the node PT. The voltage generator having an amplitude VTX, is coupled, through the transmitting metal plate PT, with an overlying stretch of fluid; this coupling is modelled with the impedance ZT1. This stretch of fluid also has an impedance ZT2 which derives part of the current generated by the transmitting metal plate towards the ground—or rather towards the metal body of the pipe to which the transmitting metal plate 21 is applied.

The receiving metal plate of the second communication module MC2 is represented in the electronic diagram of FIG. 7 by the node PR; this receiving metal plate 22 is coupled with the overlying stretch of fluid; this coupling is modelled with the impedance ZR1. This stretch of fluid also has an impedance ZR2 which derives part of the current close to the receiving metal plate towards the ground, or towards the metal body of the pipe to which the receiving metal plate 22 is applied. The receiving metal plate is in turn connected to the electronic processing and control unit of the second communication module schematized, in particular, as an amplifier with low input impedance current ZIN (approximately zero) which in fact amplifies the current signal that crosses the receiving metal plate, obtaining a voltage signal VRX, containing the information received.

If the transmitting metal plates 21 and the receiving metal plates 22 have the form of a cylindrical arc, the coupling efficiency of the same plates with the fluid surrounding the pipe string substantially depends on the length of the longitudinal section of this arc and the angle described by the arc. The greater the length of the angle and the closer this is to 360°, the greater the efficiency of the above-mentioned coupling will be.

If the communication module 20 also comprises, in addition to the metal plates 21, 22, 35, transmitting and receiving coils, the cylindrical arc preferably does not trace a complete angle of 360°, to avoid parasite currents induced on the metal plates 21, 22, 35 during the excitation of the coils.

With respect to the transmission of signals between two communication modules through the transmitting and receiving coils 25, 26, the schematic views of FIGS. 8 and 9 should be considered as being exemplary. In particular, the magnetic field lines generated by a transmitting coil 25 and concatenated to a receiving coil 26, are represented in FIG. 9.

As can be observed, the arrangement of the coils in a configuration coaxial to the connecting pipes 50 of the pipe string 60 allows the magnetic field flow which is concatenated with the receiving coil 26, to be maximized. The receiving coil 26, in fact, substantially encloses the whole circumferential extension of the pipe for cableless bidirectional data transmission and continuous circulation 50 made of ferromagnetic steel, in which most of the magnetic field flow is confined. The signal useful for the heads of the receiving coil 26 thus contains the contributions of the whole magnetic field distribution generated by the transmitting coil 25 from the position of the receiving coil onwards.

The characteristics of the pipe for cableless bidirectional data transmission and continuous circulation and the pipe string object of the present invention are evident from the description, as also the relative advantages are clear.

The transmission towards the surface of the detections of the sensors located in the well takes place in a safe and inexpensive manner and substantially in real time, allowing a continuous monitoring of the well-bottom parameters in real time, therefore allowing to increase the safety during drilling, in particular during the delicate steps of a change or addition of pipe in the pipe string, thanks to the possibility of intervening immediately in the case of the detection of anomalies and deviations from the expected parameters.

In fact, through the data management and analysis in real time, the change in the formations crossed and deviations in the trajectory of the well with respect to the program can be identified immediately, allowing operational decisions to be taken more rapidly and intervening with corrective actions.

The pipe string, according to the present invention, moreover, also allows all the well-bottom data to be provided during the well control phases, in which the Blow Out Preventer (BOP) is closed, or during all the managed pressure drilling applications.

The data are transmitted in continuous also in the presence of circulation losses. There is no longer the necessity of slowing down the operations for sending commands to the automatic well-bottom equipment to set or correct the drilling trajectory.

The capacity of transmitting large volumes of data, maintaining high drilling advance rates, allows log while drilling measurements to be sent to the surface in real time with a higher definition than the current standard, and the possibility of permanently replacing existing wireline logs.

The possibility of having sensors along the whole drill string allows the continuous monitoring along the whole axis of the well of parameters such as pressure, temperature, voltage loads and compression, torsion, bending. This allows, for example, string grip events, washout identification, etc., to be prevented and effectively solved.

The field of application mainly refers to the drilling step of an oil well but does not exclude use also during the production step. The pipe for cableless bidirectional data transmission and continuous circulation can in fact be integrated both within a drill string and a completion string and in any case in all situations in which data can be transmitted or received from the well bottom or from intermediate points along the pipeline.

Integration in a single object of the communication module and valves for continuous circulation also allows a reduction in the installation times of these devices along the pipe string. In order to ensure the monitoring of the well conditions and continuous circulation in the case of a change or addition of a pipe, the installation of a single device, the pipe for cableless bidirectional data transmission and continuous circulation, is in fact required.

The compact dimensions of this pipe for cableless bidirectional data transmission and continuous circulation also allow the maximum lengths for the pipe strings provided on drilling machines currently existing, to be respected.

Finally, the pipe for cableless bidirectional data transmission and continuous circulation and the pipe string thus conceived can evidently undergo numerous modifications and variants, all included in the invention; furthermore, all the details can be substituted by technically equivalent elements. In practice, the materials used, as also the dimensions, can vary according to technical requirements.

The invention claimed is:

1. A pipe for cableless bidirectional data transmission and the continuous circulation of a stabilizing fluid in a well for the extraction of formation fluids, comprising:

a hollow tubular body which extends in length along a longitudinal direction (X) and which is configured at the ends for being coupled with respective drill or completion pipes;

a radial valve associated with said tubular body arranged to control flow of the stabilizing fluid in a substantially radial or transversal direction with respect to the longitudinal direction (X), said radial valve being a flapper valve and being connectable to a pumping system of a drilling rig outside said tubular body allowing passage of the stabilizing fluid inside said hollow tubular body for generating an inside flow directed towards the bottom of the well;

an axial valve associated with said tubular body arranged to control the flow of the stabilizing fluid along said longitudinal direction (X), said axial valve being a flapper valve;

a communication module associated with said tubular body comprising:

at least one metal plate selected from:

a transmitting metal plate;

a receiving metal plate;

a transceiver metal plate;

an electronic processing and control unit configured for processing signals to be transmitted by means of said at least one metal plate of the transmitting metal plate or the transceiver metal plate, or signals received by means of said at least one metal plate of the receiving metal plate or the transceiver metal plate;

one or more supply batteries for feeding said metal plates and said electronic processing and control unit;

the one or more supply batteries and the electronic processing and control unit are housed in one or more first housings that are closed towards the outside of the tubular body, the at least one metal plate is housed in at least one second housing that is open towards the outside of the tubular body, the one or more first housings and the at least one second housing extend along the longitudinal direction (X);

said signals being transmitted between said communication module and a consecutive communication module that can be positioned at pre-established intervals of one or more drill or completion pipe wherein the transmission of said signals takes place by injecting into the fluid surrounding the pipe string, from said at least one metal plate of the transmitting metal plate or the transceiver metal plate of said communication module, an electric current carrying an information signal.

2. The pipe for cableless bidirectional data transmission and the continuous circulation of a stabilizing fluid in a well for the extraction of formation fluids according to claim 1, wherein said communication module comprises at least one transmitting coil and at least one receiving coil coaxial with respect to each other and coaxial with respect to the longitudinal axis of said tubular body.

3. The pipe for cableless bidirectional data transmission and the continuous circulation of a stabilizing fluid in a well for the extraction of formation fluids according to claim 2, wherein said at least one transmitting coil and said at least one receiving coil are superimposed with respect to each other.

4. The pipe for cableless bidirectional data transmission and the continuous circulation of a stabilizing fluid in a well for the extraction of formation fluids according to claim 2, wherein said supply batteries and said electronic processing and control unit are housed in the first housing of said tubular body, whereas said at least one metal plate and said coils are housed in the second housing of said tubular body.

5. The pipe for cableless bidirectional data transmission and the continuous circulation of a stabilizing fluid in a well for the extraction of formation fluids according to claim 4, wherein said first housing and said second housing are located in the longitudinal direction (X) below said radial valve.

6. The pipe for cableless bidirectional data transmission and the continuous circulation of a stabilizing fluid in a well for the extraction of formation fluids according to claim 4, wherein said first housing is located at said radial valve whereas said second housing is located at said axial valve.

7. A pipe string for a drilling rig of a generic well for the extraction of formation fluids comprising a plurality of pipes connected to each other in succession, said plurality of pipes comprising a plurality of drill or completion pipes and a plurality of pipes for cableless bidirectional data transmission and continuous circulation according to claim 1 having a length shorter than that of said drill or completion pipes.

8. The pipe string according to claim 7, wherein said pipes for cableless bidirectional data transmission and continuous circulation are positioned between two drill or completion pipes at predetermined intervals of one or more drill or completion pipes.

* * * * *